US006581245B2

(12) United States Patent
Jen

(10) Patent No.: US 6,581,245 B2
(45) Date of Patent: Jun. 24, 2003

(54) FOLDABLE HANDLE ASSEMBLY

(75) Inventor: Yuchi Jen, Taoyuan (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/948,087

(22) Filed: Sep. 6, 2001

(65) Prior Publication Data

US 2002/0138948 A1 Oct. 3, 2002

(30) Foreign Application Priority Data

Mar. 29, 2001 (TW) ..... 90204878 U

(51) Int. Cl.[7] ..... E05D 11/10
(52) U.S. Cl. ..... 16/408; 16/334; 16/900
(58) Field of Search ..... 16/334, 408, 114.1, 16/444, 445, 443, 900, 35 R

(56) References Cited

U.S. PATENT DOCUMENTS 3,082,473 A * 3/1963 West ..... 16/445
4,271,731 A * 6/1981 Suligoy et al. ..... 81/177.7
5,168,601 A * 12/1992 Liu ..... 16/445
5,412,842 A * 5/1995 Riblett ..... 16/334
5,887,927 A * 3/1999 Kurek, III et al. ..... 16/415
6,318,741 B1 * 11/2001 Chen ..... 16/900
6,341,406 B1 * 1/2002 Beckman ..... 16/444
6,401,301 B1 * 6/2002 Hung ..... 16/900

* cited by examiner

*Primary Examiner*—Thomas B. Will
*Assistant Examiner*—Tara L. Mayo
(74) *Attorney, Agent, or Firm*—Fay, Sharpe, Fagan, Minnich & McKee, LLP

(57) ABSTRACT

A foldable handle assembly includes a handle, two connecting devices, two resilience devices, two balls and two shafts. Each of the connecting devices includes a base and a projecting post wherein the projecting post has a first ball receptacle and a second ball receptacle and the base has a screwed recess. When the handle is operated such that the ball is inserted into the first ball receptacle, the handle is securely held in a first position, and when the handle is operated such that the ball is inserted into the second ball receptacle, the handle is securely held in a second position.

11 Claims, 8 Drawing Sheets

FOLDABLE HANDLE ASSEMBLY

FIELD OF THE INVENTION

The present invention relates to a foldable handle assembly, and more particularly to a foldable handle assembly installed on a panel of an appliance.

BACKGROUND OF THE INVENTION

A typical foldable handle assembly principally includes a handle for grasping. When the handle is operated to a folded position, the handle is securely stored. When the handle is operated to an upright position, the handle is securely held and accessible for a user to pull the appliance.

A power supply module has a foldable handle assembly mounted on a panel thereof, and thus it can be pulled out for checking and repairing the components therewithin. Please refer to FIGS. 1(*a*) and 1(*b*). The typical foldable handle assembly includes a handle 10, two connecting devices 12, two balls 13, two resilience devices 14 and two shafts 15. The two ends of the handle 10 are arc-shaped, wherein each has two recesses 101, 102 and a hole 104. The recess 101 and recess 102 are respectively disposed on the tip and a side surface of the arc-shaped end. The connecting device 12 is principally cup-shaped, wherein its shell has a notch 124 and two openings 122, 123 corresponding to the hole 104 and the shaft 15. The connecting device 12 further includes a male-screwed post 121 formed on the bottom surface thereof. A resilience device receptacle 127 is disposed on a top surface of male-screwed post 121, as can be seen in FIG. 1(*c*), for receiving the resilience device 14 and the ball 13. Referring to FIG. 1(*c*), when the handle 10 is operated to an upright position, i.e. a position for pulling the appliance, the ball 13 is inserted into the first ball recess 101 by the resilience force generated from the resilience device 14 and thus the handle 10 is securely held in the upright position. When the handle 10 is operated to a stored position, the handle 10 is folded through the notch 124 and the ball 13 is inserted into the second ball recess 102 by the resilience force generated from the resilience device 14 and thus the handle 10 is securely held in the stored position. FIG. 1(*d*) is a schematic view illustrating that a typical handle assembly is coupled to a panel 161 of an appliance by passing the male-screwed posts 121 through bores 162 of the panel 161 and then fastening the male-screwed posts 121 on the panel 161 with corresponding hexagonal nuts 163.

Although the above-mentioned foldable handle assembly is capable of being securely held either in an upright position or a folded position, it still has some drawbacks as follows:

1. For fastening the male-screwed posts 121 on the panel 161, a corresponding hexagonal sleeve (not shown) is required to rotate the hexagonal nuts 163. The nuts are typically operated manually, which is labor-intensive and time-consuming. In addition, the hexagonal sleeve is not a common tool in a production line.
2. The connection of the male-screwed post 121 and the nut 163 occupies partly the interior space of the appliance, which is disadvantageous for miniaturization of the appliance.
3. Sine the male-screwed post 121 and the nut 163 are usually made of metal, extra insulation is needed for preventing operators from getting electrical shock and for avoiding electrical connection of the nut 163 and the electronic components within the appliance, which is costly.

4. Since the receptacle 127 is formed by drilling off a portion of the male-screwed post 121, it is found that the strength thereon is weak and the handle assembly is easily broken when the appliance is very weighty.

Therefore, the present invention provides an improved foldable handle assembly so as to overcome the problems described above.

SUMMARY OF THE INVENTION

It is an object of the present invention to provide a foldable handle assembly, which is connected to a panel by a commonly used screw bolt.

It is another object of the present invention to provide a foldable handle assembly for saving interior space of an appliance when the foldable handle assembly is coupled with the panel of the appliance.

It is another object of the present invention to provide a foldable handle assembly to avoid electrical connection with electronic components within the appliance.

It is another object of the present invention to provide a foldable handle assembly to increase strength where it is connected to the panel.

In accordance with an aspect of the present invention, there is provided a foldable handle assembly installed on a panel of an appliance. The foldable handle assembly includes a handle, two connecting devices, two resilience devices, two balls and two shafts. Each end of the handle has a resilience device receptacle and protrudes to form two parallel plates, wherein each plate has a hole. Each of the resilience devices is disposed within the resilience device receptacle. Each of the balls is in contact with the resilience device. Each of the connecting devices includes a base and a projecting post wherein the projecting post has a first ball receptacle and a second ball receptacle corresponding to the resilience device receptacle and a channel corresponding to the hole, and the base has a screwed recess for being fastened on the panel. Each of the shafts is inserted into the hole and the channel as a pivot. When the handle is operated such that the ball is inserted into the first ball receptacle, the handle is securely held in a first position, and when the handle is operated such that the ball is inserted into the second ball receptacle, the handle is securely held in a second position.

Preferably, the first ball receptacle and the second ball receptacle are disposed on a tip and a side surface of the projecting post, respectively.

Preferably, the resilience device is a spring.

Preferably, the shaft is a pin.

Preferably, the first position is an upright position and the second position is a folded position.

Preferably, the appliance is a power supply module.

Preferably, the appliance is one of a drawer and a brief case.

In accordance with another aspect of the present invention, there is provided a foldable handle assembly installed on a panel of a power supply module. The foldable handle assembly includes a handle, two connecting devices, two resilience devices, two balls and two shafts, and is characterized in that: each end of the handle has a resilience device receptacle and protrudes to form two parallel plates wherein each plate has a hole; each of the resilience devices is disposed within the resilience device receptacle; each of the balls is in contact with the resilience device; each of the connecting devices includes a base and a projecting post wherein the projecting post has a first ball receptacle and a second ball receptacle respectively disposed on a tip and a side surface of the projecting post and a channel corresponding to the hole, and the base has a screwed recess for being fastened on the panel; and each of the shafts is inserted into the hole and the channel as a pivot, wherein when the handle is operated such that the ball is inserted into the first ball receptacle, the handle is securely held in an upright position, and when the handle is operated such that the ball is inserted into the second ball receptacle, the handle is securely held in a folded.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is perspective view of FIG. 1(*a*);

FIG. 1(*c*) is a partially side-sectional view of FIG. 1(*b*);

FIG. 1(*d*) is a schematic view showing that the foldable handle assembly in FIG. 1(*b*) is installed on a panel of an appliance;

FIG. 2(*b*) is perspective view of FIG. 2(*a*);

FIG. 3(*b*) is a schematic sectional view illustrating the foldable handle assembly according to the present invention is operated between the folded position and an upright position;

FIG. 3(*c*) is a schematic sectional view illustrating the foldable handle assembly according to the present invention is securely held in the upright position.

DETAILED DESCRIPTION OF THE PREFERRED EMBODIMENT

Figure 1A:
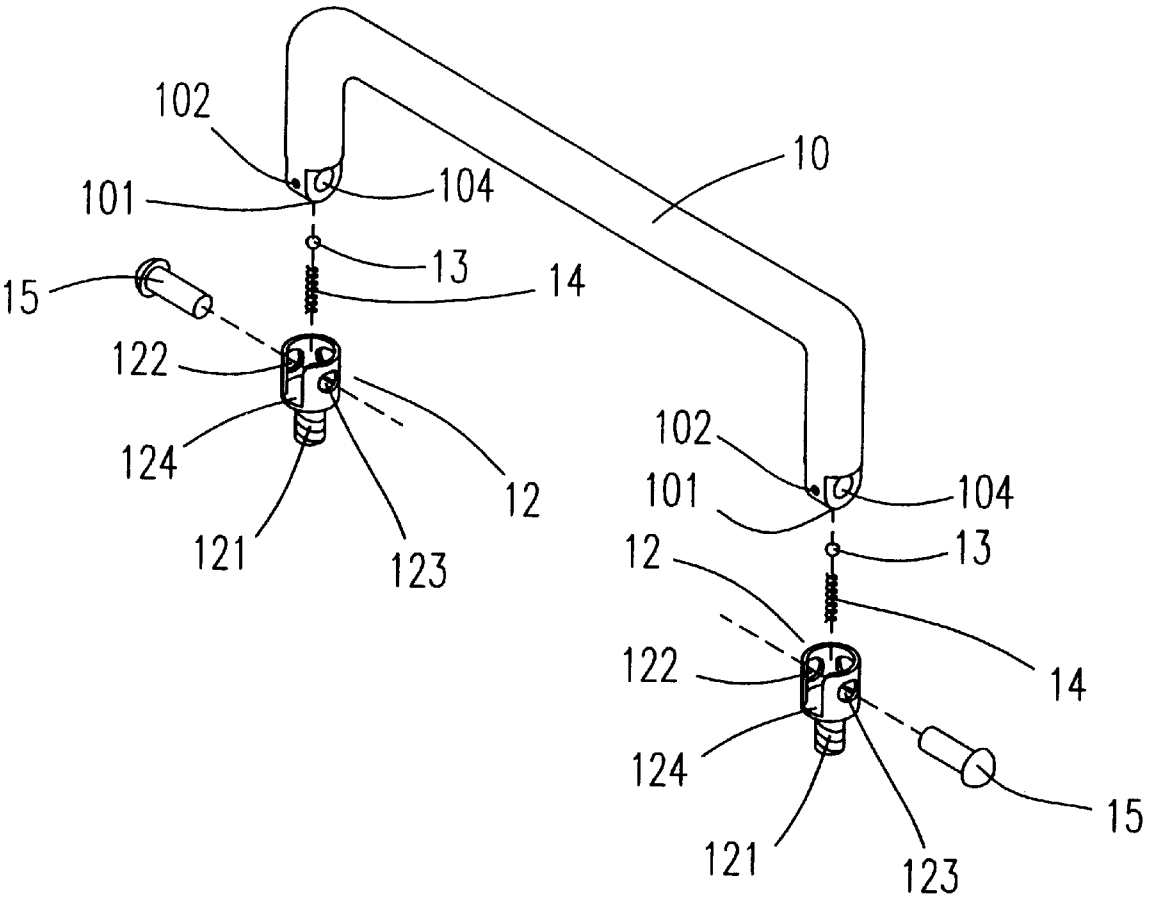
Fig. 1(a)(PRIOR ART)
FIG. 1(*a*) is an exploded view of a foldable handle assembly according to prior art.
Figure 1B:
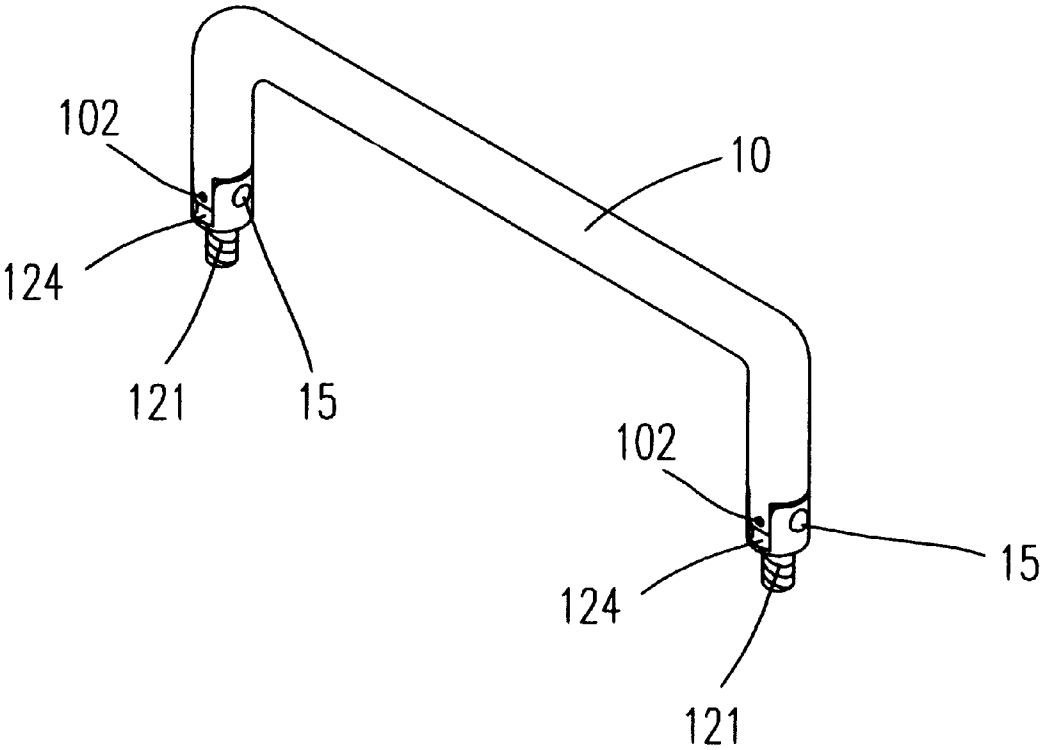
Fig. 1(b)(PRIOR ART)
Figure 1C:
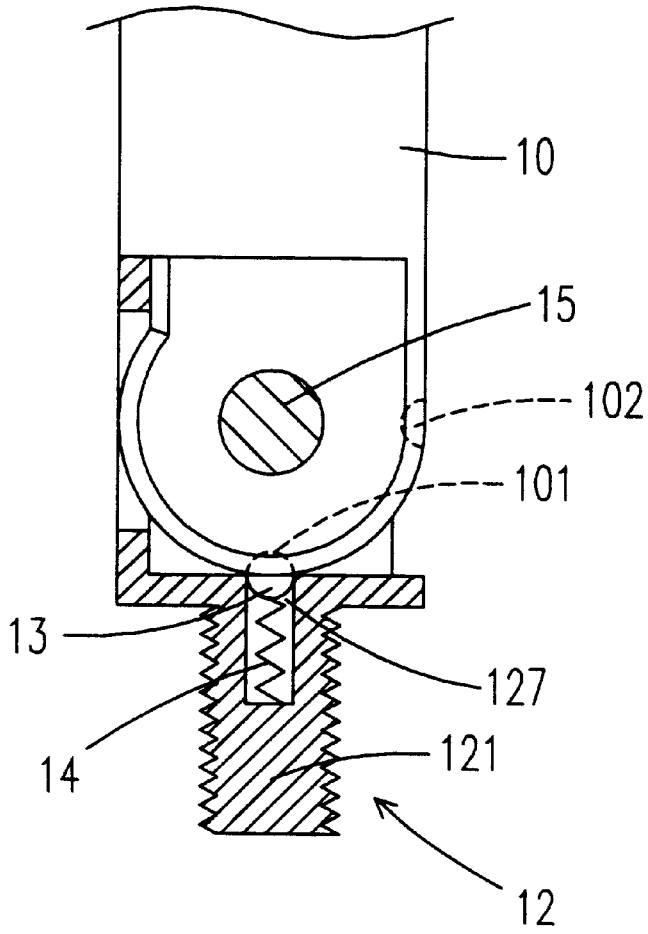
Fig. 1(c)(PRIOR ART)
Figure 1D:
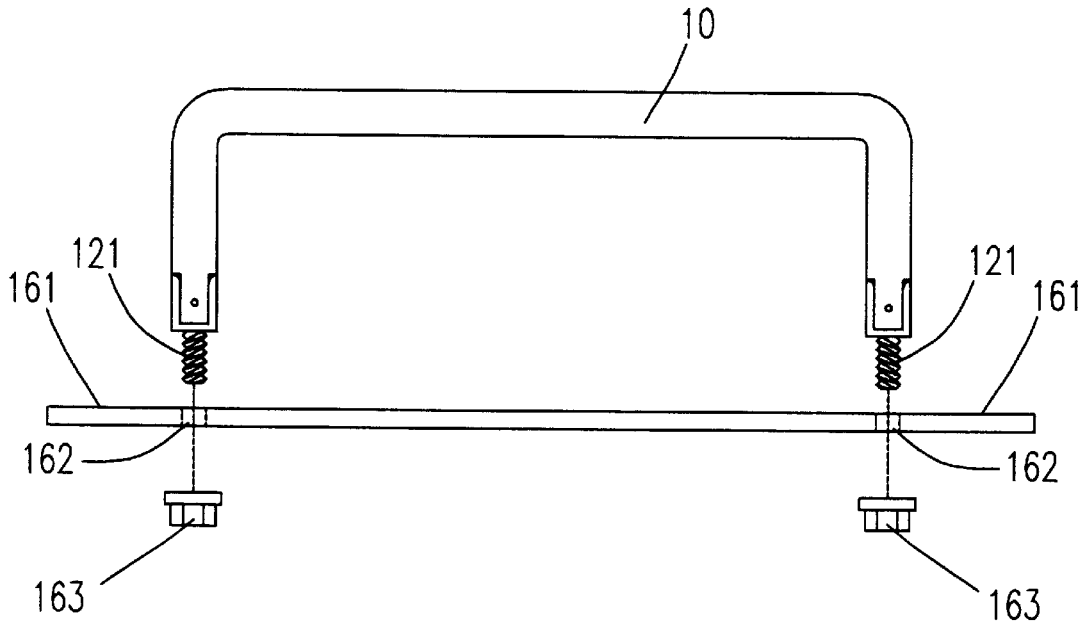
Fig. 1(d)(PRIOR ART)
Figure 2A:
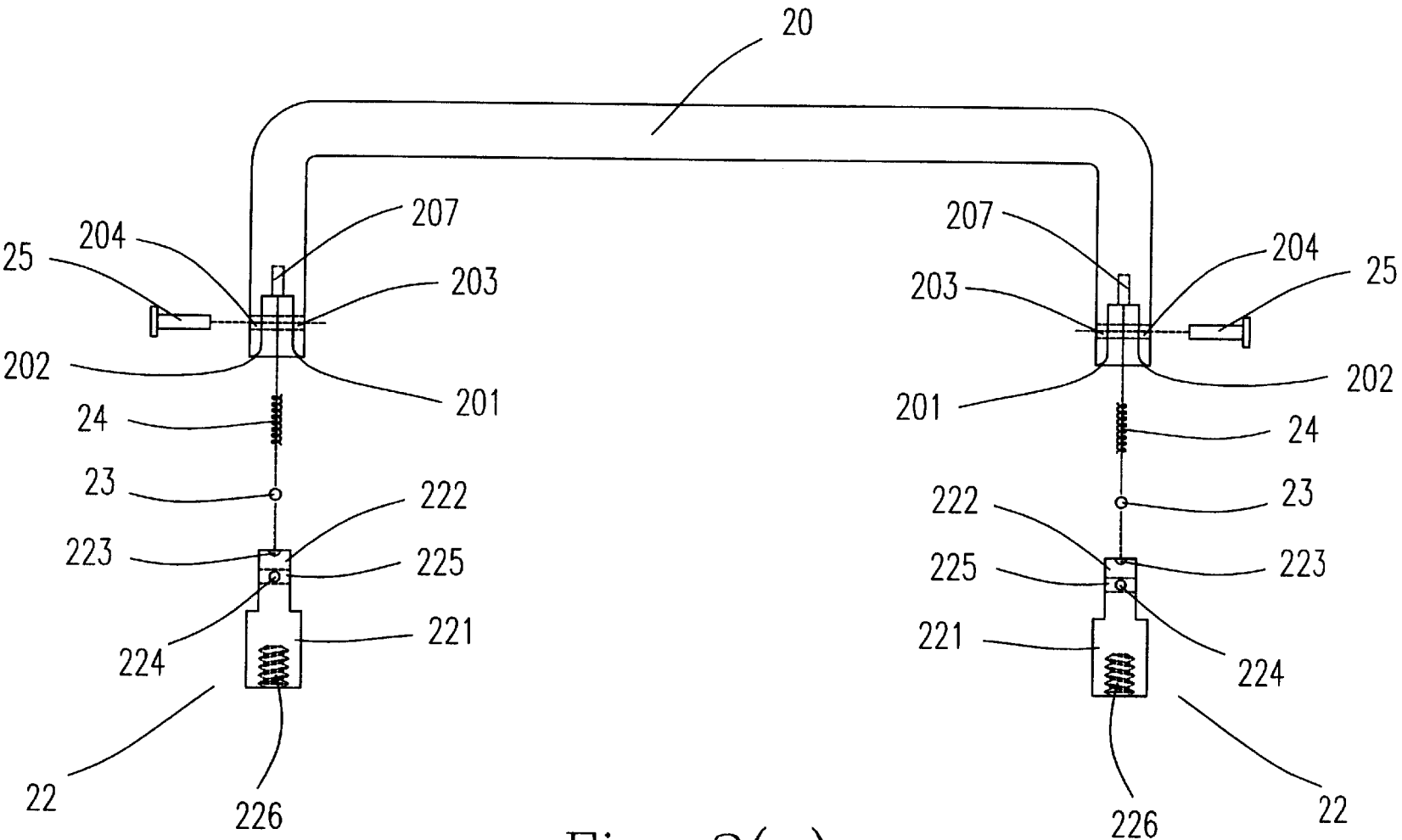
FIG. 2(*a*) is an exploded view of a foldable handle assembly according to a preferred embodiment of the present invention.
Figure 2B:
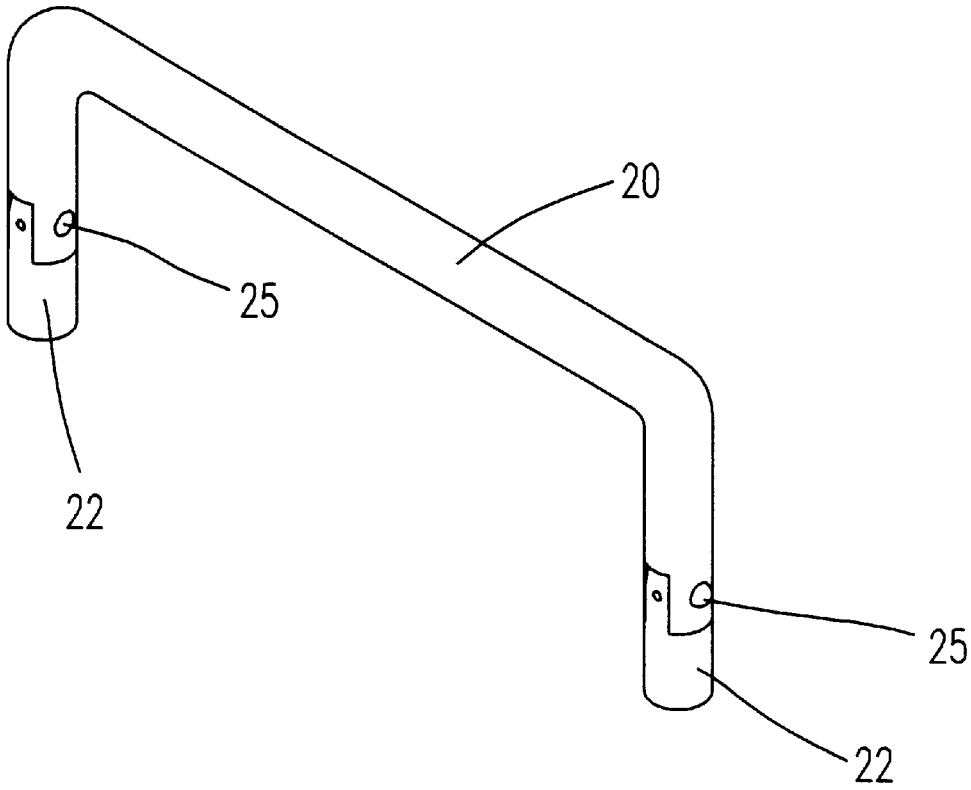

FIGS. 2(*a*) and 2(*b*) are respectively exploded and perspective views of the foldable handle assembly according to a preferred embodiment of the present invention. The foldable handle assembly includes a handle 20, two connecting devices 22, two balls 23, two resilience devices 24 and two shafts 25.

Each end of the handle 20 protrudes to form two parallel plates 201 and 202 and has a resilience device receptacle 207. Each of the plates 201 and 202 has holes 203 and 204, respectively.

Each connecting device 22 includes a base 221 and a projecting post 222. The projecting post 222 has a first ball receptacle 223 and a second ball receptacle 224 corresponding to the resilience device receptacle 207. In this embodiment, the first ball receptacle 223 and the second ball receptacle 224 are disposed on a tip and a side surface of the projecting post 222, respectively. The connecting device 22 further includes a channel 225 corresponding to the holes 203 and 204 of the handle 20. The width of the projecting post 222 is slightly lower than the distance between the two parallel plates 201 and 202; therefore, the projecting base 222 can be placed between the two parallel plates 201 and 202. The base 221 has a screwed recess 226 extending from the bottom surface thereof. The resilience device 24 in this embodiment is a spring and disposed within the resilience device receptacle 207. The ball 23 is in contact with the resilience device 24 for obtaining resilience force to be urged against either the first ball receptacle 223 or the second ball receptacle 224 such that the handle 20 can be securely held in either the upright position or the folded position.

When the shaft 25 is inserted into the hole 203, the channel 225 and the hole 204, the foldable handle assembly of the present invention is finished. In this embodiment, the shaft 25 is a pin.

Figure 3A:
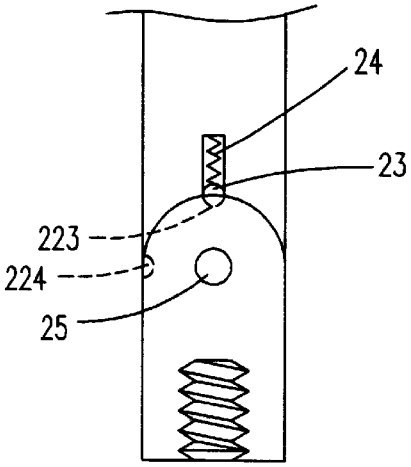
FIG. 3(*a*) is a schematic view illustrating the foldable handle assembly according to the present invention is securely held in a folded position.
Figure 3B:
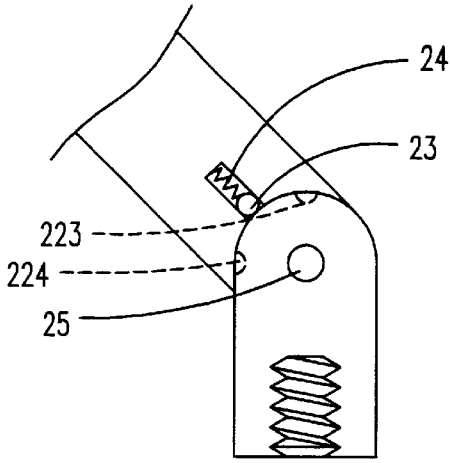
Figure 3C:
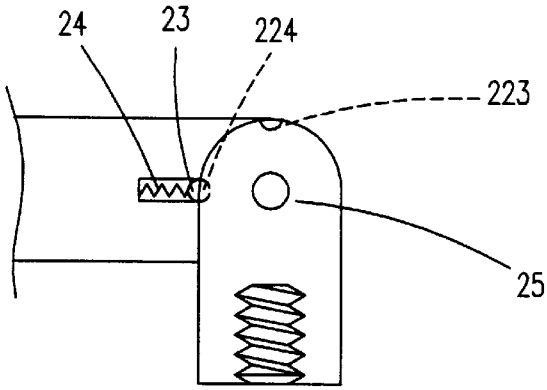

Please refer to FIGS. 3(*a*) and 3(*c*). It will be found that the foldable handle assembly of the present invention can be securely held either in an upright position or a folded position by allowing the ball 23 to be inserted into either the first ball receptacle 223 or the second ball receptacle 224. The shaft 25 is used as a pivot. In FIG. 3(*b*), the foldable handle assembly is not securely held when it is operated between the upright and the folded position, because the balls 23 are not inserted into either the first ball receptacle 223 or the second ball receptacle 224.

Figure 4:
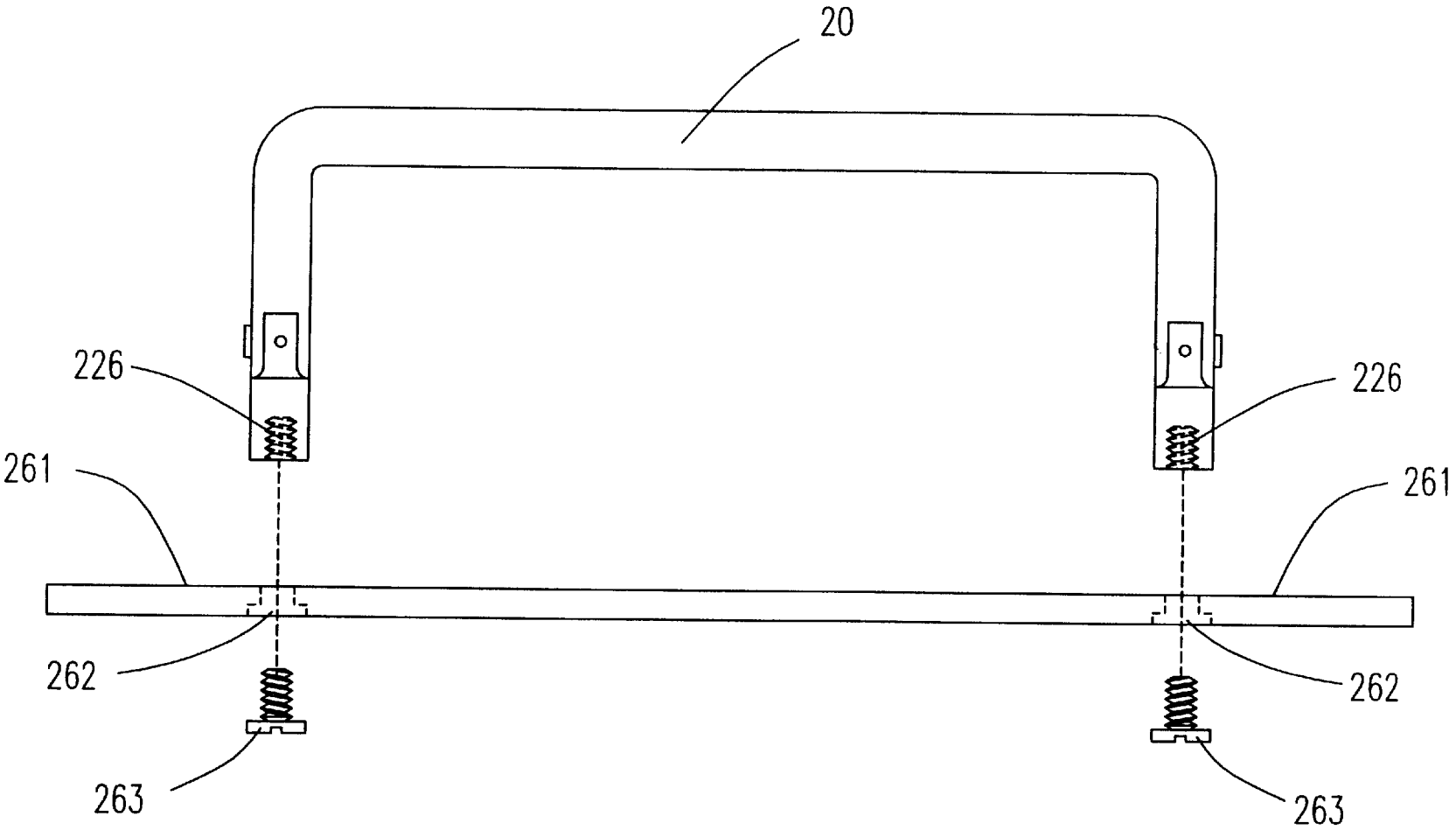
FIG. 4 is a view illustrating the foldable handle assembly according to the present invention is installed on a panel of an appliance.

Referring to FIG. 4, the foldable handle assembly according to the present invention is connected with a panel 261 of an appliance by passing screw bolts 263 through bores 262 of the panel 261 and then fastening the screwed recess 226 of the foldable handle assembly on the panel 261.

The foldable handle assembly of the present invention is preferably adapted but not limited to be used in an electrical appliance, a drawer and a brief case.

As will be apparent from the above description according to the present invention, the foldable handle assembly has the following advantages:

1. The handle assembly of the present invention is installed on the panel 261 by coupling the screwed recess 223 with the screw bolt 263. Since screw bolt is a commonly used element and can be operated with a screwdriver or even pneumatic tools or power-driven tools, the assembling process is simple.
2. Since the head of screw bolt 263 is much thinner than the nut 163 in the prior art, the screw bolt 263 occupies little or no interior space of the appliance, which is advantageous for miniaturization of the appliance.
3. Extra insulation between the screw bolt 263 and the components, because the screw bolt 263 occupies little or no interior space of the appliance.
4. While it is known that the screwed recess 226 on the base 221 and the resilience device receptacle 127 on the male-screwed post 121 may reduce the strength of the base 221 and the male-screwed post 121, the strength of the base 221 in the present invention is much larger than that of the male-screwed post 121 in the prior art when comparing their sizes.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A foldable handle assembly installed on a panel of an appliance, comprising a handle, two connecting devices, two resilience devices, two balls and two shafts, characterized in that:

each end of said handle has a resilience device receptacle and protrudes to form two parallel plates, each plate having a hole;

each of said resilience devices is disposed within said respective resilience device receptacle;

each of said balls is in contact with said respective resilience device;

each of said connecting devices comprises a base and a projecting post wherein said projecting post has a first ball receptacle and a second ball receptacle corresponding to said respective resilience device receptacle and a channel corresponding to said respective hole, and said base has a screwed recess for being fastened on said panel; and each of said shafts is inserted into said respective hole and said respective channel as a pivot, wherein when said handle is operated such that said respective ball is inserted into said respective first ball receptacle, said handle is securely held in a first position, and when said handle is operated such that said respective ball is inserted into said respective second ball receptacle, said handle is securely held in a second position.

2. The foldable handle assembly according to claim 1, wherein said first ball receptacle and said second ball receptacle are disposed on a tip and a side surface of said projecting post, respectively.

3. The foldable handle assembly according to claim 1, wherein each of said resilience devices is a spring.

4. The foldable handle assembly according to claim 1, wherein each of said shafts is a pin.

5. The foldable handle assembly according to claim 1, wherein said first position is an upright position.

6. The foldable handle assembly according to claim 1, wherein said second position is a folded position.

7. The foldable handle assembly according to claim 1, wherein said appliance is a power supply module.

8. The foldable handle assembly according to claim 1, wherein said appliance is one of a drawer and a brief case.

9. A foldable handle assembly installed on a panel of a power supply module, comprising a handle, two connecting devices, two resilience devices, two balls and two shafts, characterized in that:

each end of said handle has a resilience device receptacle and protrudes to form two parallel plates, each plate having a hole;

each of said resilience devices is disposed within said respective resilience device receptacle;

each of said balls is in contact with said respective resilience device;

each of said connecting devices comprises a base and a projecting post wherein said projecting post has a first ball receptacle and a second ball receptacle respectively disposed on a tip and a side surface of said projecting post and a channel corresponding to said respective hole, and said base has a screwed recess for being fastened on said panel; and each of said shafts is inserted into said respective hole and said respective channel as a pivot, wherein when said handle is operated such that said ball is inserted into said respective first ball receptacle, said handle is securely held in an upright position, and when said handle is operated such that said ball is inserted into said respective second ball receptacle, said handle is securely held in a folded position.

10. The foldable handle assembly according to claim 9, wherein each of said resilience devices is a spring.

11. The foldable handle assembly according to claim 9, wherein each of said shafts is a pin.

* * * * *